US007034856B2

(12) United States Patent
Miyajima et al.

(10) Patent No.: US 7,034,856 B2
(45) Date of Patent: Apr. 25, 2006

(54) RECEIVING CLOTH FOR THERMAL TRANSFER RECORDING, AND METHOD OF THERMAL TRANSFER RECORDING USING THE CLOTH

(75) Inventors: Shigeru Miyajima, Fuji (JP); Yoshifumi Noge, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 505 days.

(21) Appl. No.: 10/308,536

(22) Filed: Dec. 3, 2002

(65) Prior Publication Data

US 2003/0133004 A1 Jul. 17, 2003

(30) Foreign Application Priority Data

Dec. 7, 2001 (JP) ..... 2001-374746

(51) Int. Cl.
*B41J 2/325* (2006.01)

(52) U.S. Cl. ..... 347/213

(58) Field of Classification Search ..... 347/213, 347/215, 221, 171–172; 156/235; 400/120.01, 400/120.02, 120.04, 120.06, 120.16, 490; 428/327, 40.1

See application file for complete search history.

(56) References Cited

U.S. PATENT DOCUMENTS

| | | | | |
|---|---|---|---|---|
| 5,071,823 A | | 12/1991 | Matsushita et al. | |
| 5,229,189 A | | 7/1993 | Hiyoshi et al. | 428/195 |
| 5,229,349 A | | 7/1993 | Kurisu et al. | 503/200 |
| 5,250,346 A | | 10/1993 | Nagai et al. | 428/195 |
| 5,716,477 A | | 2/1998 | Yamaguchi et al. | 156/230 |
| 5,773,112 A | * | 6/1998 | Tachikawa et al. | 428/40.1 |
| 6,063,488 A | * | 5/2000 | Sato et al. | 428/327 |
| 6,117,562 A | | 9/2000 | Yamaguchi et al. | 428/532 |
| 6,196,738 B1 | * | 3/2001 | Shimizu et al. | 400/490 |
| 6,548,149 B1 | * | 4/2003 | Liu et al. | 156/235 |

FOREIGN PATENT DOCUMENTS

| | | |
|---|---|---|
| EP | 0 545 893 A1 | 6/1993 |
| JP | 2001 341441 A | 12/2001 |
| WO | WO 98/03724 | 1/1998 |

OTHER PUBLICATIONS

U.S. Appl. No. 07/805,046, filed Dec. 11, 1991, claims & abstract only.
U.S. Appl. No. 08/548,478, filed Oct. 26, 1995, claims & abstract only.

* cited by examiner

*Primary Examiner*—K. Feggins
(74) *Attorney, Agent, or Firm*—Cooper & Dunham LLP

(57) ABSTRACT

A receiving cloth for thermal transfer recording, including at least a substrate formed of a woven or nonwoven fabric, having opposed sides; an ink receiving layer on one side of the substrate, which receives a heat-melted or softened ink; and a tackifying layer on the other side of the substrate, wherein the ink receiving layer includes at least a hollow particulate material including a gaseous body therein; and a thermoplastic material, and wherein the ink receiving layer has an island/sea structure in which the hollow particulate material is present as an island in a sea of the thermoplastic material. In addition, a thermal printing method using the receiving cloth is also provided.

17 Claims, 1 Drawing Sheet

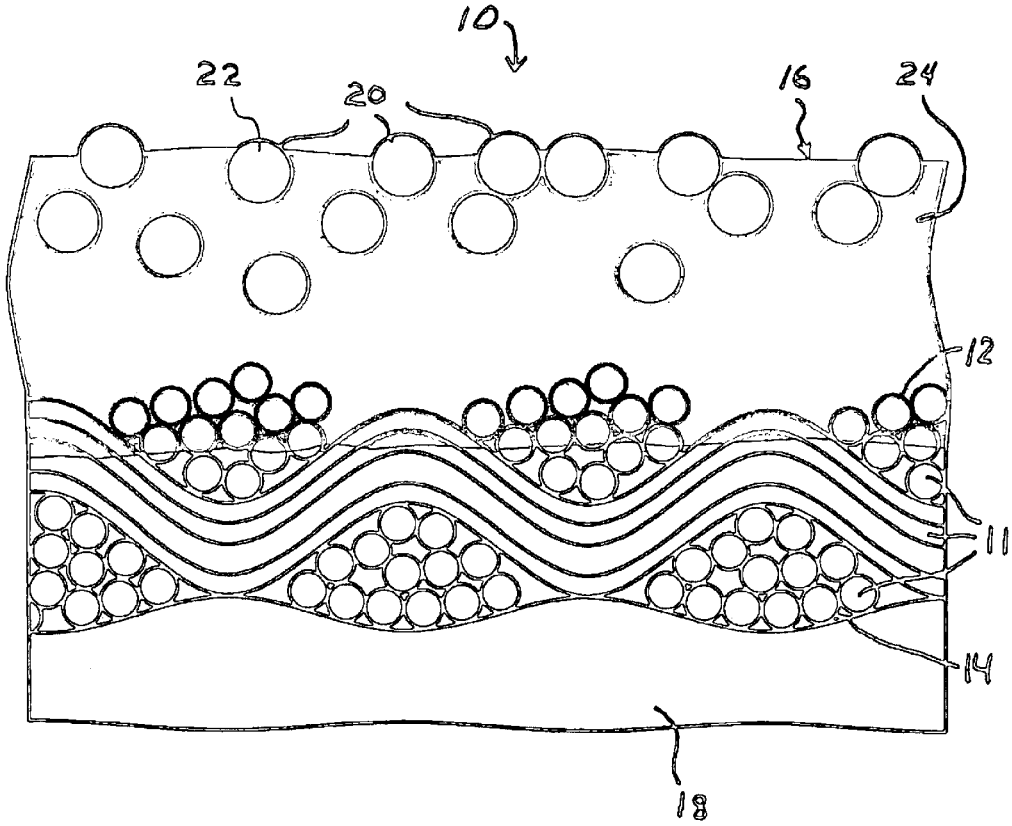
10
22
20
16
24
12
11
14
18

RECEIVING CLOTH FOR THERMAL TRANSFER RECORDING, AND METHOD OF THERMAL TRANSFER RECORDING USING THE CLOTH

BACKGROUND OF THE INVENTION

1. Field of the Invention

The present invention relates to a cloth having good transfer-image acceptability, washability and heat resistance, which is used in combination with a thermal transfer recording medium including a heat-meltable ink layer on a substrate, and to a thermal transfer recording method using the cloth.

2. Discussion of the Related Art

As one of various thermal transfer recording methods, a heat-meltable thermal transfer recording method of forming various information and images on a receiving material including an ink receiving layer on a substrate using a heat-meltable thermal transfer recording medium having a heat-meltable ink layer is known. This material is widely used for record labels, display labels and advertising materials, etc.

In addition, in cleaning industries, improvements of operating efficiency are promoted using a barcode, e.g., cleaning tags made of a receiving material on which a client management barcode is printed are widely used.

Substrates of receiving materials typically include plastic films such as papers, polyester, polypropylene and polyethylene or synthetic papers. Since a receiving material used as a display label for clothes, a drop curtain for advertisement, a cleaning tag and the like is exposed to a detergent, a washing with a detergent including a bleach, a drying, an ironing, etc., the receiving material is required to have washability and heat resistance as well as a texture and a mechanical strength. Therefore, for such applications, there may be used a receiving material (cloth) including an ink receiving layer formed from a polyester resin or a polyurethane resin on a substrate formed of a woven or nonwoven fabric.

However, since the woven or nonwoven fabric has a low surface smoothness, it is difficult to print a uniform and strong transfer image thereon with a thermal transfer recording medium.

In order to improve transfer-image acceptability of the above-mentioned receiving cloth, various improvements are attempted, e.g., Japanese Laid-Open Patent Publication No. 7-89252 discloses to form an ink receiving layer including a fine particulate constituent and a resin on the cloth, and Japanese Patent Publication No. 4-50920 discloses to form an ink receiving layer including a porous polyurethane resin formed from a water-in-oil polyurethane emulsion. However, these are not satisfactory as follows.

The ink receiving layer including a fine particulate constituent and a resin does not have good printed images because of having low transfer uniformity, and needs a high printing energy in printing. Although the ink receiving layer including a porous polyurethane resin formed from a water-in-oil polyurethane emulsion can form uniform transfer images, since the ink receiving layer is formed by coating a liquid including an organic solvent in which an urethane resin is dissolved and water is dispersed in a fine particulate shape, the coating liquid is required to be evaporated and have high viscosity in its production process. In addition, it also has a production problem of needing the organic solvent.

Because of these reasons, a need exists for a receiving cloth for thermal transfer recording, having good transfer-image acceptability, washability and heat resistance.

SUMMARY OF THE INVENTION

Accordingly, an object of the present invention is to provide a receiving cloth for thermal transfer recording, having good transfer-image acceptability, washability and heat resistance.

In addition, another object of the present invention is to provide a method of recording using the receiving cloth for thermal transfer recording.

Briefly these objects and other objects of the present invention as hereinafter will become more readily apparent can be attained by a receiving cloth for thermal transfer recording, including at least a substrate formed of a woven or nonwoven fabric, having opposed sides; an ink receiving layer on one side of the substrate, which receives a heat-melted or softened ink; and a tackifying layer on the other side of the substrate, wherein the ink receiving layer includes at least a hollow particulate material including a gaseous body therein; and a thermoplastic material, and wherein the ink receiving layer has an island/sea structure in which the hollow particulate material is present as an island in a sea of the thermoplastic material.

These and other objects, features and advantages of the present invention will become apparent upon consideration of the following description of the preferred embodiments of the present invention.

BRIEF DESCRIPTION OF THE DRAWING

The single FIGURE is an enlarged schematic fragmentary cross-sectional view of a receiving cloth embodying the present invention in a particular form.

DESCRIPTION OF THE PREFERRED EMBODIMENTS

Generally, the present invention provides a receiving cloth for thermal transfer recording, having good transfer-image acceptability, washability and heat resistance.

In addition, the present invention provides a method of recording using the receiving cloth for thermal transfer recording.

In the present invention, a receiving cloth for thermal transfer recording, which has an ink receiving layer having an island/sea structure in which a hollow particulate material is present as an island in a sea of a thermoplastic material, particularly has good transfer-image acceptability, washability and heat resistance.

Substrates including the ink receiving layer are not particularly limited, a woven or nonwoven fabric made of known fibers such as nylon fibers, acrylic fibers, polyester fibers, rayon fibers and cotton fibers can be used. However, a polyester taffeta fiber having a denier of from 30 to 150 d is preferably used because of having good workability and chlorine bleach resistance.

In addition, the woven or nonwoven fabric as a substrate is preferably treated with a heat not less than 100° C. before an ink receiving layer is formed thereon in order to improve heat resistance of the substrate, and to prevent shrinkage and curl thereof due to ironing, etc. In addition, the temperature may optionally be fixed based on a desired heat resistant temperature of the substrate, and a fiber used for the woven or nonwoven fabric may previously be treated with a heat.

As mentioned above, the ink receiving layer of the present invention has an island/sea structure in which the hollow particulate material is present as an island in a sea of the thermoplastic material.

The island/sea structured ink receiving layer is formed by a method of coating and drying an ink receiving layer coating liquid including the hollow particulate material and thermoplastic material. When the ink receiving layer coating liquid having a low viscosity is coated on a substrate formed of a woven or nonwoven fabric, a part of the thermoplastic material selectively permeates a fiber thereof and the hollow particulate material is formed thereon. Thus, the island/sea structure in the ink receiving layer is formed by the hollow particulate material present as an island in a sea of the thermoplastic material.

The thus formed ink receiving layer has a strong adherence to the woven or nonwoven fabric as a substrate, and good washability, transfer-image acceptability and heat resistance.

Further, a difference of a specific gravity of the hollow particulate material and thermoplastic material gathers more hollow particulate material up to a surface of the ink receiving layer and the thermoplastic material down to the substrate of the woven or nonwoven fabric. Therefore, since the thermoplastic material more easily permeates the substrate, adherence between the woven or nonwoven fabric and the ink receiving layer becomes stronger, resulting in good washability, transfer-image acceptability and heat resistance.

In order to obtain the ink receiving layer coating liquid having a low viscosity, a thermoplastic material which is insoluble or hardly soluble with water is preferably used as an emulsion.

A coating amount of the coating liquid is from 10 to 100 $g/m^2$. When the coating amount is less than 10 $g/m^2$, transfer-image acceptability of the resultant ink receiving layer deteriorates. When greater than 100 $g/m^2$, a texture of the resultant ink receiving layer deteriorates.

Materials for the hollow particulate material are not limited, a hollow particulate material formed from an acrylic resin, a styrene resin, an acrylic-styrene resin, a vinylidene chloride resin or the like is preferably used in order to improve organic solvent resistance.

Shapes of the hollow particulate material are not limited, and any known hollow particulate materials including an air or other gaseous bodies therein can be used. However, a hollow particulate material having a weight-average particle diameter of from 0.1 to 10 μm and a hollow rate not less than 75% is preferably used in order to keep a balance among cushion, adiathermancy and transfer-image acceptability of the hollow particulate material.

When the weight-average particle diameter is less than 0.1 μm, the hollow particulate material does not have sufficient cushion and adiathermancy. When greater than 10 μm, surface smoothness of the hollow particulate material deteriorates and a transfer image defect such as a void occurs.

When the hollow rate is less than 75%, the hollow particulate material has not only insufficient cushion and adiathermancy but also cannot form a good island/sea structure because of having a large specific gravity of the particulate material. It is more preferable that the hollow rate of the hollow particulate material is not less than 80%.

Further, a thickness of a shell of the hollow particulate material is almost automatically fixed according to the particle diameter and hollow rate of the hollow particulate material. However, the shell thereof preferably has a thickness of from 0.05 to 5 μm because it is easily broken in forming an ink receiving layer or an image when less than 0.05 μm and its cushion and adiathermancy deteriorate when greater than 5 μm.

The hollow rate of the hollow particulate material is a volume percent of a gaseous body included therein.

The ink receiving layer of the present invention includes the hollow particulate material and the thermoplastic material in a weight proportion (the hollow particulate material/the thermoplastic material) of from 1/9 to 4/6. When the proportion is less than 1/9, transfer-image acceptability of the ink receiving layer deteriorates. When greater than 4/6, strength and washability of the ink receiving layer deteriorate.

The thermoplastic materials used as a binder in the ink receiving layer are not particularly limited if they can receive and keep a heat-melted or softened ink. Specific example of the thermoplastic materials include elastomers such as rubbers, polyolefin resins, polyester resins, polyamide resins, polyurethane resins, vinylchloride resins, styrene resins, butyral resins, phenol resins, acrylic nitrile resins, ethylene-vinylacetate copolymer resins, ethylene-acrylic copolymer resins, etc. Not only a thermoplastic material having a SP value close to that of a surface layer of a thermal transfer recording medium is used, but also an emulsified and dispersed aqueous emulsion of the thermoplastic material is preferably used in order to improve ink acceptability and image fixability of the ink receiving layer. An ionomer type polyester polyurethane resin is more preferably used because of having good washability.

A content of the hollow particulate material and the thermoplastic resin in the ink receiving layer is 10 to 40% by weight and 60 to 90% by weight respectively based on total weight of the ink receiving layer. When a content of the hollow particulate material is less than 10% by weight, heat sensitivity of the resultant ink receiving layer deteriorates. When greater than 40% by weight, strength of the resultant ink receiving layer deteriorates. When a content of the thermoplastic resin is less than 60% by weight, fixability of a heat melting ink deteriorates. When greater than 90% by weight, heat sensitivity of the resultant ink receiving layer deteriorates due to lower ratio of the hollow particulate material.

The ink receiving layer may include an additive such as a pigment, a fluorescent bleach and a fading inhibitor besides the above-mentioned constituents for the purpose of preventing background yellowing.

Tackifying layers on a backside of the substrate are not particularly limited, and known hot melt adhesives such as polyolefin adhesives, polyester adhesives and polyamide adhesives can be used. However, the polyamide or polyurethane adhesive is preferably used in order to improve washability of the substrate.

The tackifying layer preferably has a thickness not less than 50 μm so as to have sufficient adhesive strength and washability.

Methods of forming the tackifying layer are not particularly limited, and a method of coating a liquid including the hot melt adhesive dissolved in a proper solvent or a method of applying the film-shaped hot melt adhesive on a backside of a receiving cloth can be used. However, the film-shaped hot melt adhesive is preferably used because it has chlorine bleach resistance and can prevent deterioration of its adhesive power due to washing.

Methods of applying the film-shaped hot melt adhesive on a substrate are not particularly limited, and a method of adhering a hot melt coated adhesive on a glassine paper coated with a silicone release agent on a substrate by a heat roller or a method of applying a film-shaped adhesive coated with a small amount of an acrylic or SBR resin adhesive having a low glass transition temperature on a substrate can be used.

Thus, as shown in the FIGURE, a receiving cloth 10 embodying the invention includes a fabric substrate 11, having opposed sides 12 and 14; an ink receiving layer 16 on one side (side 12) of the substrate, which receives a heat-melted or softened ink; and a tackifying layer 18 on the other side (side 14) of the substrate. The ink receiving layer 16 includes at least a hollow particulate material 20 including a gaseous body 22 therein, and a thermoplastic material 24. Layer 16 has an island/sea structure in which the hollow particulate material 20 is present as an island in a sea of the thermoplastic material 24.

The above-mentioned receiving cloth may optionally include an intermediate layer between the substrate and the ink receiving layer. The intermediate layer is preferably an elastic resin formed from butadiene-styrene copolymers, butadiene-acrylic nitrile copolymers, ethylene-vinylacetate copolymers, ethylene-ethylacrylate copolymers, etc. in order to improve adhesive power between the substrate and the ink receiving layer.

A thermal transfer recording medium for use in combination with the receiving cloth for thermal transfer recording is a heat-melting type thermal transfer recording medium including a heat melted or softened ink layer on a substrate. The substrate includes any known materials, e.g., polyester resins such as polyethyleneterephthalate; relatively high heat resistant plastic films such as polycarbonate, triacetylcellulose, nylon and polyimide; cellophane; and parchment papers, etc.

Any known colorants can be used in the ink layer, and thermoplastic resins such as polyester resins, polyamide resins, polyurethane resins, vinyl chloride resins, styrene resins, butyral resins, phenol resins and acrylic nitrile resins having good heat resistance, mechanical strength and solvent resistance are used as a binder resin.

In addition, the ink layer optionally includes a heat melting material such as waxes or an auxiliary agent such as fillers for the purpose of improving sensitivity together with the colorant and the binder resin.

The colorant, binder resin and wax have weight ratios (colorant/binder resin/wax) of 5 to 30/30 to 95/0 to 30 in the ink layer.

An intermediate layer is optionally formed between the substrate and the ink layer for the purpose of facilitating a release of the ink layer in transferring or preventing a fall of the ink layer. In addition, a protection layer is optionally formed for the purpose of preventing background fouling when sandwiched between a thermal print head and a platen roll. Further, a heat resistant layer and/or a lubricative layer are optionally formed on an opposite side of the substrate to the side on which the ink layer is formed for the purpose of preventing a fusion bond to a thermal print head.

The transfer recording medium preferably has a surface layer formed from a resin having a solubility parameter (SP) value close to that of an ink receiving layer of a receiving cloth, and more preferably a SP value having a difference not greater than 1 from that of the ink receiving layer.

A thermal transfer recording medium for use in combination with the receiving cloth for thermal transfer recording of the present invention preferably has a surface layer including a thermoplastic resin having a melting point no less than 100° C., and more preferably a nitrocellulose resin or a polyester resin. With such a combination, the resultant transfer image has good image transferability, washability and heat resistance.

In addition, the surface layer represents a protection layer when the protection layer is formed on an ink layer, and represents an ink layer when a protection layer is not formed thereon.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

[Preparation for a Thermal Transfer Recording Medium]

A separation layer forming liquid a having the following formula was coated by a wire bar coating method on a side of a PET film as a substrate having a thickness of 4.5 μm and a heat resistant lubricative layer on the other side thereof, such that a coated amount was 0.5 g/m$^2$ after dried at 80° C. for 15 sec.

| Separation layer forming liquid a | |
|---|---|
| Polyethylene wax (Polywax 850 from Toyo Petrolite Co., Ltd.) | 10 |
| Butadiene rubber (A liquid solution of Bon RI-1 from Konishi Co., Ltd. including 5% of toluene of 5%) | 10 |
| Ethylene-vinylacetate resin (Evaflex EV250 from Du Pont-Mitsui Polychemicals Co., Ltd.) | 0.2 |
| Toluene | 79.8 |

Thus, a separation layer was formed on the substrate.

Next, an ink layer forming liquid having the following formula was coated by a wire bar coating method on the separation layer such that a coated amount was 1.2 g/m$^2$ after dried to prepare a thermal transfer recording medium a.

| Ink layer forming liquid a | |
|---|---|
| Carbon black | 5 |
| Nitrocellulose resin | 10 |
| Carnauba wax | 4 |
| Methyl ethyl ketone | 81 |

In addition, the procedures of preparation for the thermal transfer recording medium a were repeated except for using an ink layer forming liquid b having the following formula instead of the ink layer forming liquid a to prepare a thermal transfer recording medium b.

| Ink layer forming liquid b | |
|---|---|
| Carbon black water dispersion liquid (Solid content 20%) | 5 |
| carnauba wax emulsion (Solid content 30%) | 10 |
| Water | 60 |
| Methanol | 25 |

Example 1

[Preparation for a Receiving Cloth Label 1 for Thermal Transfer Recording]

An ink receiving layer forming liquid a having the following formula was coated by a wire bar coating method on a polyester taffeta as a substrate (190 fibers/inch$^2$ 75D) such that a coated amount was 27 g/m$^2$ after dried. Then, the coated substrate was calendered to form an ink receiving layer thereon to prepare a receiving cloth. Next, a polyurethane adhesive film (Thermolite film 6501 from Dicel Chemical Industries, Ltd. having a thickness of 100 μm) applied onto a glassine paper having a weight of 60 g/m$^2$ and a surface coated with a silicone release agent was applied to a backside of the receiving cloth by a heating roller (120° C.×0.5 kg/cm×3 sec) to form a tackifying layer thereon to prepare a receiving cloth label 1.

| Ink receiving layer forming liquid a | |
|---|---|
| Hollow particulate material (Matsumoto Microfair R-24 from Matsumoto Yushi Seiyaku Co., Ltd. having a hollow rate of 91%, a particle diameter of 2 μm and a solid content of 40%) | 12 |
| Ionomer type polyester polyurethane resin aqueous emulsion (Hydran APX101-H from Dainippon Ink & Chemicals, Inc. having a solid content of 45%) | 50 |
| Water | 38 |

Example 2

[Preparation for a Receiving Cloth Label 2 for Thermal Transfer Recording]

The procedures of preparation for the receiving cloth label 1 in Example 1 were repeated except for using a polyester taffeta as a substrate (190 fibers/inch$^2$ 275D) which was treated with a heat at 150° C. for 30 sec to prepare a receiving cloth label 2.

Example 3

[Preparation for a Receiving Cloth Label 3 for Thermal Transfer Recording]

The procedures of preparation for the receiving cloth label 2 in Example 2 were repeated except for using a polyester polyurethane resin aqueous emulsion (Bondic 1850N from Dainippon Ink & Chemicals, Inc. having a solid content of 40%) instead of the ionomer type polyester polyurethane resin aqueous emulsion in the ink receiving layer forming liquid a to prepare a receiving cloth label 3.

Example 4

[Preparation for a Receiving Cloth Label 4 for Thermal Transfer Recording]

The procedures of preparation for the receiving cloth label 2 in Example 2 were repeated except for using a polyester adhesive film (Thermolite film 2810 from Dicel Chemical Industries, Ltd. having a thickness of 100 μm) to prepare a receiving cloth label 4.

Example 5

[Preparation for a Receiving Cloth Label 5 for Thermal Transfer Recording]

The procedures of preparation for the receiving cloth label 2 in Example 2 were repeated except that after a polyamide tackifying layer forming liquid having the following formula was heated at 50° C. and had a temperature of 50° C., the liquid was coated on the backside of the receiving cloth and dried such that the layer had a thickness of 100 μm to prepare a receiving cloth label 5.

| Tackifying layer forming liquid a | |
|---|---|
| Copolymerized nylon resin (750 from Dicel Hurtz) | 20 |
| Toluene | 40 |
| Methanol | 40 |

Example 6

[Preparation for a Receiving Cloth Label 6 for Thermal Transfer Recording]

The procedures of preparation for the receiving cloth label 2 in Example 2 were repeated except for using an ink receiving layer forming liquid b having the following formula instead of the ink receiving layer forming liquid a to prepare a receiving cloth label 6.

| Ink receiving layer forming liquid b | |
|---|---|
| Hollow particulate material (ROHPAQUE HP-91 from Rohm and Haas Japan, K. K. having a hollow rate of 50%, a particle diameter of 1 μm and a solid content of 28%) | 17 |
| Ionomer type polyester polyurethane resin aqueous emulsion (Hydran APX101-H from Dainippon Ink & Chemicals, Inc. having a solid content of 45%) | 50 |
| Water | 33 |

Example 7

[Preparation for a Receiving Cloth Label 7 for Thermal Transfer Recording]

The procedures of preparation for the receiving cloth label 1 in Example 1 were repeated except for using a nylon taffeta as a substrate (190 fibers/inch$^2$ 70D) to prepare a receiving cloth label 7.

Comparative Example 1

[Preparation for a Receiving Cloth Label 8 for Thermal Transfer Recording]

The procedures of preparation for the receiving cloth label 1 in Example 1 were repeated except for using an ink receiving layer forming liquid c having the following formula instead of the ink receiving layer forming liquid a to prepare a receiving cloth label 8.

| Ink receiving layer forming liquid c | |
|---|---|
| Styrene-acrylic resin particulate material (Almatex SPMM-47BF from Mitsui Kagaku Fine Chemicals, Inc. having a hollow rate of 0%, a particle diameter of 0.6 μm and a solid content of 47%) | 10 |
| Ionomer type polyester polyurethane resin aqueous emulsion (Hydran APX101-H from Dainippon Ink & Chemicals, Inc. having a solid content of 45%) | 50 |
| Water | 40 |

Comparative Example 2

[Preparation for a Receiving Cloth Label 9 for Thermal Transfer Recording]

The procedures of preparation for the receiving cloth label 1 in Example 1 were repeated except for using an ink receiving layer forming liquid d having the following formula instead of the ink receiving layer forming liquid a to prepare a receiving cloth label 9.

| Ink receiving layer forming liquid d | |
|---|---|
| Silica dioxide (Mizucasil P603 from Mizusawa Industrial Chemicals Ltd. having a hollow rate of 0% and a particle diameter of 2 μm) | 4.8 |
| Styrene-acrylic resin aqueous emulsion (Johncryl 60 from Johnson Polymer having a solid content of 45%) | 45 |
| Water | 50.2 |

Comparative Example 3

[Preparation for a Receiving Cloth Label 10 for Thermal Transfer Recording]

The procedures of preparation for the receiving cloth label 8 in Comparative Example 1 were repeated except for replacing the tackifying layer with a polyolefin adhesive film (Thermolite film 9100 from Dicel Chemical Industries, Ltd. having a thickness of 30 μm) to prepare a receiving cloth label 10.

[Evaluation of the Receiving Cloth Labels]

The receiving cloth labels prepared in Example 1 to 7 and Comparative Examples 1 to 3 were printed with the above-mentioned thermal transfer recording medium a under the following conditions, and the printed image qualities were evaluated.

Comparative Example 4

The receiving cloth label Comparative Examples 1 was printed with the above-mentioned thermal transfer recording medium b under the following conditions, and the printed image quality was evaluated.

| Printing conditions |
|---|
| Thermal head: partially glazed thin film head (8 dot/mm) |
| Platen pressure: 150 g/cm |
| Release angle of the recording medium: 30° |
| Release torque: 200 g |
| Printing speed: 100 mm/sec |

Evaluation Items (1) Transferability (Printability)

Under the above-mentioned printing conditions, a solid image was printed on the receiving cloth label with a printing energy of 18, 20 and 22 mj/mm$^2$, and the image density was measured by a Macbeth densitometer RD914 to evaluate the transferability.

(2) Washability of Printed Image and Tackifying Layer

A cotton cloth was applied to the tackifying layer of the receiving cloth label printed under the above-mentioned printing conditions (printing energy 22 mj/mm$^2$) with an iron having a temperature of 180° C. to prepare a sample for evaluation.

Washability-1 (Detergent Washability)

After the above-mentioned sample was washed for 3 times according to JIS L0844 A-5, the image density was measured to evaluate the image washability. In addition, washability (adhesiveness) of the tackifying layer was evaluated based on whether there was a peeling thereof.

Evaluation of Adhesiveness

×: Totally peeled off

Δ: Partially peeled off

○: Not peeled

Washability-2 (Chlorine Bleach Washability)

The procedures of evaluation of Washability-1 were repeated except for adding 3 g of a bleach (Kitchen Highter from Kao Corp.) into the detergent.

(3) Heat Resistance

A cotton cloth was applied to the tackifying layer of the receiving cloth label printed under the above-mentioned printing conditions (printing energy 22 mj/mm$^2$) with an iron having a temperature of 180° C. to prepare a sample, and heat resistance (shrinkage) of the receiving cloth was evaluated according to a state of curl after ironing.

Evaluation of Heat Resistance

×: largely curled (largely shrunk with a heat)

Δ: Slightly curled (slightly shrunk with a heat)

○: Not curled (not shrunk with a heat)

The evaluation results are shown in Table 1.

TABLE 1

| | Transferability | | | Washability | | | | |
|---|---|---|---|---|---|---|---|---|
| | | | | Washability-1 | | Washability-2 | | |
| | 18 (mj/mm$^2$) | 20 (mj/mm$^2$) | 22 (mj/mm$^2$) | Image | Adhesive-ness | Image | Adhesive-ness | Heat Resistance |
| Ex. 1 | 0.66 | 1.35 | 1.63 | 1.21 | ○ | 1.03 | ○ | X |
| Ex. 2 | 0.72 | 1.36 | 1.68 | 1.28 | ○ | 1.10 | ○ | ○ |
| Ex. 3 | 0.82 | 1.44 | 1.64 | 0.75 | ○ | 0.63 | ○ | ○ |
| Ex. 4 | 0.70 | 1.33 | 1.69 | 1.30 | ○ | 1.05 | ○ | ○ |
| Ex. 5 | 0.70 | 1.38 | 1.70 | 1.28 | Δ | 1.01 | Δ | ○ |
| Ex. 6 | 0.12 | 0.95 | 1.42 | 1.08 | ○ | 0.73 | ○ | ○ |
| Ex. 7 | 0.65 | 1.33 | 1.63 | 1.12 | ○ | 0.77 | Δ | X |
| Com. Ex. 1 | 0.12 | 0.43 | 0.72 | 0.32 | ○ | 0.12 | ○ | X |
| Com. Ex. 2 | 0.12 | 0.32 | 0.65 | 0.12 | ○ | 0.12 | ○ | X |
| Com. Ex. 3 | 0.12 | 0.42 | 0.76 | 0.28 | X | 0.12 | X | X |
| Com. Ex. 4 | 1.07 | 1.35 | 1.46 | 0.12 | ○ | 0.12 | ○ | X |

This document claims priority and contains subject matter related to Japanese Patent Application No. 2001-374746 filed on Dec. 7, 2001, incorporated herein by reference.

Having now fully described the invention, it will be apparent to one of ordinary skill in the art that many changes and modifications can be made thereto without departing from the spirit and scope of the invention as set forth therein.

What is claimed is:

1. A receiving cloth for thermal transfer recording, comprising:

a substrate having opposed sides and comprising a member selected from the group consisting of woven fabrics and nonwoven fabrics;

an ink receiving layer, located overlying one side of the substrate, which receives a heat-melted or softened ink; and a tackifying layer located overlying the other side of the substrate, wherein the ink receiving layer comprises:

a hollow particulate material including a gaseous body therein; and a thermoplastic material, and wherein the ink receiving layer has an island/sea structure in which the hollow particulate material is present as an island in a sea of the thermoplastic material.

2. The receiving cloth of claim 1, wherein the hollow particulate material has a weight-average particle diameter of from 0.1 to 10 μm and a hollow rate not less than 75%.

3. The receiving cloth of claim 1, wherein the hollow particulate material has a shell comprising a resin selected from the group consisting of acrylic resins, styrene resins, acrylic-styrene resins and vinylidene chloride resins.

4. The receiving cloth of claim 3, wherein the shell of the hollow particulate material has a thickness of from 0.05 to 5 μm.

5. The receiving cloth of claim 1, wherein the thermoplastic material comprises a polyester polyurethane ionomer resin.

6. The receiving cloth of claim 1, wherein the substrate comprises a fabric comprising a polyester resin and subjected to a heat treatment at a temperature not less than 100° C.

7. The receiving cloth of claim 6, wherein the substrate is a woven fabric comprising a polyester taffeta fiber having a denier of from 30 to 150 d.

8. The receiving cloth of claim 1, wherein the tackifying layer is a thermal adhesive film comprising a member selected from the group consisting of polyamide resins and polyurethane resins.

9. The receiving cloth of claim 1, wherein the ink receiving layer has a weight of 10 to 100 g/m$^2$.

10. The receiving cloth of claim 1, wherein a weight ratio of the hollow particulate material to the thermoplastic material in the ink receiving layer is from 1/9 to 4/6.

11. The receiving cloth of claim 1, wherein the tackifying layer has a thickness not less than 50 μm.

12. The receiving cloth of claim 1, further comprising an intermediate layer between the ink receiving layer and the substrate.

13. The receiving cloth of claim 12, wherein the intermediate layer comprises a resin selected from the group consisting of butadiene-styrene copolymers, butadiene-acrylic nitrile copolymers, ethylene-vinylacetate copolymers and ethylene-ethylacrylate copolymers.

14. A thermal printing method comprising:

heating a thermal transfer recording medium to form an ink image on a receiving cloth, wherein the receiving cloth is the receiving cloth according to claim 1.

15. The thermal printing method of claim 14, wherein the thermal transfer recording medium comprises a surface layer comprising a thermoplastic resin having a melting point not less than 100° C.

16. The thermal printing method of claim 15, wherein the thermoplastic resin comprises a resin selected from the group consisting of nitrocellulose resins and polyester resins.

17. The thermal printing method of claim 15, wherein the thermoplastic material in the ink receiving layer of the receiving cloth comprises a thermoplastic resin, wherein each of the thermoplastic resin in the thermal transfer recording medium and the thermoplastic resin in the receiving cloth has a solubility parameter, and wherein a difference therebetween is not greater than 1.

* * * * *